US011678116B1

(12) United States Patent
Kontomichos et al.

(10) Patent No.: US 11,678,116 B1
(45) Date of Patent: Jun. 13, 2023

(54) OPTIMIZATION OF A HYBRID ACTIVE NOISE CANCELLATION SYSTEM

(71) Applicant: Dialog Semiconductor B.V., s-Hertogenbosch (NL)

(72) Inventors: Fotios Kontomichos, Patras (GR); Wessel Harm Lubberhuizen, Delden (NL); Paul Shields, Dunblane (GB); Georgios Flamis, Patras (GR)

(73) Assignee: Dialog Semiconductor B.V., 's-Hertogenbosch (NL)

( * ) Notice: Subject to any disclaimer, the term of this patent is extended or adjusted under 35 U.S.C. 154(b) by 0 days.

(21) Appl. No.: 17/334,167

(22) Filed: May 28, 2021

(51) Int. Cl.
*H04R 3/00* (2006.01)
*G10K 11/178* (2006.01)
*H04R 3/02* (2006.01)

(52) U.S. Cl.
CPC ..... *H04R 3/02* (2013.01); *G10K 11/178* (2013.01)

(58) Field of Classification Search
CPC ..... H04R 1/1083; H04R 3/00; H04R 3/005; H04R 3/02; H04R 3/04; H04R 25/43; H04R 25/45; H04R 25/407; G10K 11/16; G10K 11/175; G10K 11/178; G10K 11/1781; G10K 11/17813; G10K 11/17815; G10K 11/17817; G10K 11/17825; G10K 11/17827; G10K 11/17853; G10K 11/17854; G10K 11/1787; G10K 11/17879
See application file for complete search history.

(56) References Cited

U.S. PATENT DOCUMENTS

| | | | | |
|---|---|---|---|---|
| 5,182,774 | A | 1/1993 | Bourk | |
| 5,425,105 | A | 6/1995 | Lo et al. | |
| 6,278,786 | B1 | 8/2001 | McIntosh | |
| 8,798,283 | B2 * | 8/2014 | Gauger, Jr. | H04R 3/002 381/71.6 |
| 9,437,182 | B2 * | 9/2016 | Doclo | G10K 11/17854 |
| 9,837,066 | B2 * | 12/2017 | Wurtz | G10K 11/17885 |
| 10,034,092 | B1 | 7/2018 | Nawfal | |
| 10,950,213 | B1 * | 3/2021 | Lu | G10K 11/17881 |
| 11,189,261 | B1 * | 11/2021 | Lu | G10K 11/17881 |
| 2004/0264706 | A1 | 12/2004 | Ray et al. | |
| 2010/0002889 | A1 | 1/2010 | Jorgensen et al. | |
| 2010/0166206 | A1 | 7/2010 | Macours | |
| 2011/0007907 | A1 * | 1/2011 | Park | G10K 11/17855 381/71.8 |
| 2012/0170766 | A1 * | 7/2012 | Alves | H04R 1/1083 381/71.11 |

(Continued)

OTHER PUBLICATIONS

MATLAB and Simulink Robotics Arena, "Introduction to Filter Design," by Connell D/Souza et al., Mar. 6, 2018, https://www.youtube.com/watch?v=VFt3UVw7VrE.

(Continued)

*Primary Examiner* — Thang V Tran
(74) *Attorney, Agent, or Firm* — Saile Ackerman LLC; Stephen B. Ackerman

(57) ABSTRACT

A computer-implemented method for automatically optimizing a hybrid active noise cancellation system, the hybrid active noise cancellation system comprising a feedback filter and a feedforward filter, the method comprising optimizing the feedforward filter, thereby optimizing the hybrid active noise cancellation system, wherein optimization of the feedforward filter is dependent on the feedback filter.

17 Claims, 6 Drawing Sheets

(56) References Cited

U.S. PATENT DOCUMENTS

| | | | | |
|---|---|---|---|---|
| 2012/0250873 | A1 | 10/2012 | Bakalos et al. | |
| 2014/0126734 | A1 | 5/2014 | Gauger, Jr. et al. | |
| 2014/0314245 | A1 | 10/2014 | Asada et al. | |
| 2016/0300563 | A1* | 10/2016 | Park | G10K 11/17817 |
| 2017/0125006 | A1* | 5/2017 | Dzhigan | G10K 11/17881 |
| 2021/0082387 | A1* | 3/2021 | Ku | G10K 11/17833 |
| 2022/0322002 | A1* | 10/2022 | O'Connell | G10K 11/17823 |

OTHER PUBLICATIONS

"An Evolution-Driven Analog Circuit Topology Synthesis," by Ziga Rojec et al., 2016 IEEE Symposium Series on Computational Intelligence (SSCI), Dec. 2016, pp. 1-6, doi: 10.1109/SSCI.2016.7850184.

"Design of an Efficient Active Noise Cancellation Circuit for In-ear Headphones," by Kuan-Hung Chen et al., 2014 IEEE Asia Pacific Conference on Circuits and Systems (APCCAS), Nov. 17-20, 2014, pp. 599-602.

"A Circuit Representation Technique for Automated Circuit Design," by Jason D. Lohn et al., IEEE Transactions on Evolutionary Computation, vol. 3, No. 3, Sep. 1999, pp. 205-219.

Autodesk library.io, Datasheet to model in seconds, Parametric ECAD—MCAD content generation online, the Wayback Machine—https://web.archive.org/web.20181231233511/https://library.io/ Downloaded: Aug. 3, 2021, 11:18 AM, pp. 1-4.

"H2/H∞ Active Control of Sound in a Headrest: Design and Implementation," IEEE Transactions on Control Systems Technology, vol. 7, No. 1, Jan. 1999, pp. 79-84.

"Improved Pole Positioning for Parallel Filters Based on Spectral Smoothing and Multi-Band Warping," by Balazs Bank et al., IEEE Signal Processing Letters, vol. 18, No. 5, May 2011, pp. 299-302.

"Analog and Digital State-Space Adaptive IIR Filters," by David A. Johns, Copyright 1989, Thesis submitted for Doctor of Philosophy in the Department of Electrical Engineering, University of Toronto, Mar. 1989, 153 pages.

"Adaptive Feedback Active Noise Control Headset: Implementation, Evaluation and Its Extensions," by Woon S. Gan et al., IEEE Transactions on Consumer Electronics (vol. 51, Issue: 3, Aug. 2005), Publication: Sep. 19, 2005, pp. 975-982.

"Optimal Design of Digital IIR Filters by Model-Fitting Frequency Response Data," by Arnab K. Shaw, IEEE Transactions on Circuits and Systems II: Analog and Digital Signal Processing (vol. 42, No. 11, Nov. 1995), pp. 702-710.

U.S. Notice of Allowance, U.S. Appl. No. 16/720,358, Applicant: Kontomichos et al., dated Mar. 14, 2022, 7 pages.

"Algorithms for the Constrained Design of Digital Filters with Arbitrary Magnitude and Phase Responses," by Mathias Lang, Wein, im Jun. 1999, Dissertation, Osterr. Kunst-und Kulturverl., 2000, 232 pages.

"Direct Design of Parallel Second-Order Filters for Instrument Body Modeling," by Balazs Bank, Presented at the International Computer Conference, Proceedings vol. I, pp. 458-462, Copenhagen, Denmark, Aug. 2007.

"Optimal Feedback Control Formulation of the Active Noise Cancellation Problem: Pointwise and Distributed," by Kambiz C. Zangi, Rle Technical Report No. 583, Research Laboratory of Electronics, May 1994, 158 pages.

"Frequency-Warped Signal Processing for Audio Applications," by Aki Harma et al., Journal of the Audio Engineering Society, vol. 48, No. 11, Nov. 2000, pp. 1011-1031.

Loudspeaker and Room Response Equalization Using Parallel Filters: Comparison of Pole Positioning Strategies,: by Balazs Bank, AES 51st International Conference, Helsinki, Finland, Aug. 22-24, 2013, 10 pages.

"Frequency-Domain Steiglitz-McBride Method for Least-Squares IIT Filter Design, ARMA Modeling, and Periodogram Smoothing," by Leland B. Jackson, IEEE Signal Processing Letters, vol. 15, Jan. 4, 2008, pp. 49-52.

"Perceptually Motivated Audio Equalization Using Fixed-Pole Parallel Second-Order Filters," by Balazs Bank, IEEE Signal Processing Letters, vol. 15, May 23, 2008, pp. 477-480.

"On H∞-Optimal Sensitivity Theory for SISO Feedback Systems," by Bruce A. Francis et al., IEEE Transactions on Automatic Control, vol. AC-29, No. I, Jan. 1984, pp. 9-16.

"Frequency Warping, Basic Concepts, Operators and Transforms," by Unto K. Laine, Found: http://users.spa.aalto.fi/unski/FreqW.html, Dec. 12, 2019, 4 pages.

"Measuring short impulse responses with inverse filtered maximum-length sequences," by Pedro Cobo et al., Elsevier, ScienceDirect, Applied Acoustics 68 (2007) pp. 820-830, Available online Jun. 12, 2006.

Co-pending US Patent, "Tools and Methods for Designing Feedforward Filters for Use in Active Noise Cancelling Systems," by Fotios Kontomichos et al., U.S. Appl. No. 16/720,358, filed Dec. 19, 2019, 43 pages.

U.S. Office Action, U.S. Appl. No. 16/720,358, Applicant: Kontomichos et al., dated Aug. 27, 2020, 16 pages.

U.S. Office Action, U.S. Appl. No. 16/720,358, Applicant: Kontomichos et al., dated Dec. 15, 2020, 13 pages.

U.S. Office Action, U.S. Appl. No. 16/720,358, Applicant: Kontomichos et al., dated Apr. 16, 2021, 13 pages.

U.S. Office Action, U.S. Appl. No. 16/720,358, Applicant: Kontomichos et al., dated Jul. 22, 2021, 18 pages.

"Adapting Hearing Devices to the Individual Ear Acoustics: Database and Target Response Correction Functions for Various Device Styles," by Florian Denk et al., Trends in Hearing, vol. 22, Jun. 7, 2018, pp. 1-19.

"Equalization Filter Design for Achieving Acoustic Transparency in a Semi-Open Fit Hearing Device," by Florian Denk et al., ITG—Fachbericht 282, Speech Communication Oct. 10-12, 2018, pp. 226-230.

"Control Tutorials for MATLAB and Simulink—Introduction: Frequency Domain Methods for Controller Design", webpage accessed Nov. 18, 2022, pp. 1-13. https://ctms.engin.umich.edu/CTMS/index.php/Content/Suspension/Simulink/Modeling/Content/Animations/bbgui.fig?example=Introduction§ion=ControlFrequency.

"Stability Criteria—(Gain Margin and Phase Margin)", published Sep. 2000, gonzo@mit.edu, 4 pages, URL: https://www.mit.edu/afs.new/athena/course/2/2.010/www_f00/psets/hw3_dir/tutor3_dir/tut3_g.html.

* cited by examiner

OPTIMIZATION OF A HYBRID ACTIVE NOISE CANCELLATION SYSTEM

The present disclosure relates to a method for automatically optimizing a hybrid active noise cancellation system.

BACKGROUND

Active Noise Cancellation (ANC) enables cancellation of unwanted acoustic noise and creates a quiet ambient environment for listeners, whilst optionally leaving desired music/audio signals to be heard without degradation. ANC is achieved by producing audio signal with equal amplitude but opposite phase to the ambient noises at a listener's ear, thus using the principle of destructive wave interference to cancel unwanted extraneous noise. A typical application field of the ANC operation are the various types of headphones distinguished by the type of fitting on the listener's ear—in-ear, on-ear and over-ear.

There are typically two types of ANC attenuation paths determined by the corresponding microphone operation: feedforward (FF) and feedback (FB) ANC. FF ANC system microphones are situated externally on the headphone, capturing ambient noises before they permeate through the headphone to eardrums. A FB ANC system has microphones placed inside the headphone in close proximity to the speaker drivers, capturing soundwaves close to eardrums. In addition, these two typical designs can be combined to produce a hybrid ANC system which has superior overall performance to either FB or FF ANC systems utilized individually.

Typically, in order to tune a hybrid ANC headphone system, the following design procedure is followed:

1. Conduct specific acoustical measurements in order to define the appropriate system transfer functions.
2. Utilize the measurements in order to design the FB filter and the FF filter separately for achieving the desired ANC performance.
3. Estimate the overall ANC performance combining the attenuation of the two paths.
4. Confirm ANC performance after applying the designed filters on the device, with acoustical measurements.

Some disadvantages of the above procedure are:

1. In many cases the overall ANC performance as a combination result of the FB and FF paths cannot be correctly estimated by simply combining the separate ANC performance of each path.
2. The separate FF design does not achieve the tuning estimation once the FB path is applied.
3. The enabled FB path influences the headphone speaker response transfer function and distorts the parameters of the FF operation.
4. The FB attenuation response is typically defined at the point of the microphone and not at the listener's ear, allowing for further estimation errors.

SUMMARY

It is desirable to provide an improved method for optimizing a hybrid active noise cancellation system, when compared with known methods.

According to a first aspect of the disclosure there is provided a computer-implemented method for automatically optimizing a hybrid active noise cancellation system, the hybrid active noise cancellation system comprising a feedback filter and a feedforward filter, the method comprising optimizing the feedforward filter, thereby optimizing the hybrid active noise cancellation system, wherein optimization of the feedforward filter is dependent on the feedback filter.

Optionally, optimizing the feedforward filter comprises adjusting one or more properties of the feedforward filter.

Optionally, the one or more properties of the feedforward filter comprises a feedforward filter transfer function.

Optionally, the feedforward filter transfer function is adjusted by setting one or more filter coefficients of the feedforward filter.

Optionally, a property of the feedback filter comprises a feedback filter transfer function, and the adjustment to the feedforward filter transfer function is dependent on the feedback filter transfer function.

Optionally, the hybrid active noise cancellation system comprises a speaker driver, and the adjustment to the feedforward filter transfer function is dependent on a first frequency response at a user's ear, the first frequency response being due to the speaker driver and the first frequency response being dependent on the feedback filter transfer function.

Optionally, the computer-implemented method comprises optimizing the feedback filter prior to optimizing the feedforward filter.

Optionally, optimizing the feedback filter comprises adjusting one or more properties of the feedback filter.

Optionally, the one or more properties of the feedback filter comprises a feedback filter transfer function.

Optionally, the feedback filter transfer functions is adjusted by setting one or more filter coefficients of the feedback filter.

Optionally, optimizing the feedback filter comprises estimating a second frequency response of the adaptive noise cancellation system at a user's ear, the second frequency response being due to the feedback filter, and determining the adjustment to be applied to the feedback filter transfer function based on the second frequency response.

Optionally, determining the adjustment to be applied to the feedback filter transfer function based on the second frequency response comprising determining the feedback filter transfer function that reduces the second frequency response to approximately zero.

Optionally, determining the feedback filter transfer function that reduces the second frequency response to approximately zero comprises applying a regression method.

Optionally, the hybrid active noise cancellation system comprises: a speaker driver, a feedforward path comprising the feedforward filter and a feedforward microphone, and a feedback path comprising the feedback filter and a feedback microphone.

Optionally, a) the feedforward path comprises i) a first transfer function between an ambient noise source and the feedforward microphone, ii) the feedforward filter transfer function between the feedforward microphone and the speaker driver, and iii) a second transfer function between the speaker driver and a user's ear, and b) the feedback path comprises i) a third transfer function between the ambient noise source and the feedback microphone, ii) the feedback filter transfer function between an output of feedback microphone and an input of the speaker driver, and iii) a fourth transfer function between an input of the feedback microphone and an output of the speaker driver, and the hybrid active noise cancellation system further comprises a fifth transfer function between the ambident noise source and the user's ear.

Optionally, the computer-implemented method comprises measuring at least one of the first, second, third, fourth or fifth transfer functions.

Optionally, the computer-implemented method comprises optimizing the feedback filter prior to optimizing the feedforward filter.

Optionally, optimizing the feedback filter comprises adjusting one or more properties of the feedback filter.

Optionally, the one or more properties of the feedback filter comprises a feedback filter transfer function.

Optionally, optimizing the feedback filter comprises estimating a second frequency response of the adaptive noise cancellation system at a user's ear, the second frequency response being due to the feedback filter, and determining the adjustment to be applied to the feedback filter transfer function based on the second frequency response.

Optionally, determining the adjustment to be applied to the feedback filter transfer function based on the second frequency response comprising determining the feedback filter transfer function that reduces the second frequency response to approximately zero using one or more of the second, third, fourth and fifth transfer functions.

Optionally, the hybrid active noise cancellation system comprises a speaker driver, a feedforward path comprising the feedforward filter and a feedforward microphone, and a feedback path comprising the feedback filter and a feedback microphone.

Optionally, the computer-implemented method comprises estimating the attenuation of the feedback path, estimating the attenuation of the feedforward path, estimating the overall attenuation of the hybrid active noise cancellation system by combining the estimated attenuations of the feedback and feedforward paths, wherein optimization of the feedback and feedforward filters uses the estimated overall attenuation of the hybrid active noise cancellation system by adjusting one or more weightings used in the regression method based on the estimated overall attenuation.

Optionally, the regression method is a least mean square method and/or a weighted regression algorithmic method.

According to a second aspect of the disclosure there is provided an apparatus comprising a computer system comprising a module configured as a hybrid active noise cancellation system automatic optimization tool for the optimization of a hybrid active noise cancellation system comprising a feedback filter and a feedforward filter, the hybrid active noise cancellation system automatic optimization tool being configured to optimize the feedforward filter, thereby optimizing the hybrid active noise cancellation system, wherein optimization of the feedforward filter is dependent on the feedback filter.

Optionally, the apparatus comprises the hybrid active noise cancellation system, the hybrid active noise cancellation system comprising the computer system.

Optionally, the apparatus comprises a headphone or set of headphones, the headphone or set of headphones comprising the hybrid active noise cancellation system.

Optionally, the apparatus comprises a user interface configured to enable a user to adjust one or more parameters of the hybrid active noise cancellation system automatic optimization tool relating to the optimization of the hybrid active noise cancellation system.

It will be appreciated that the apparatus of the second aspect may include features set out in the first aspect and can incorporate other features as described herein.

BRIEF DESCRIPTION OF THE DRAWINGS

The disclosure is described in further detail below by way of example and with reference to the accompanying drawings, in which.

DETAILED DESCRIPTION

Figure 1:
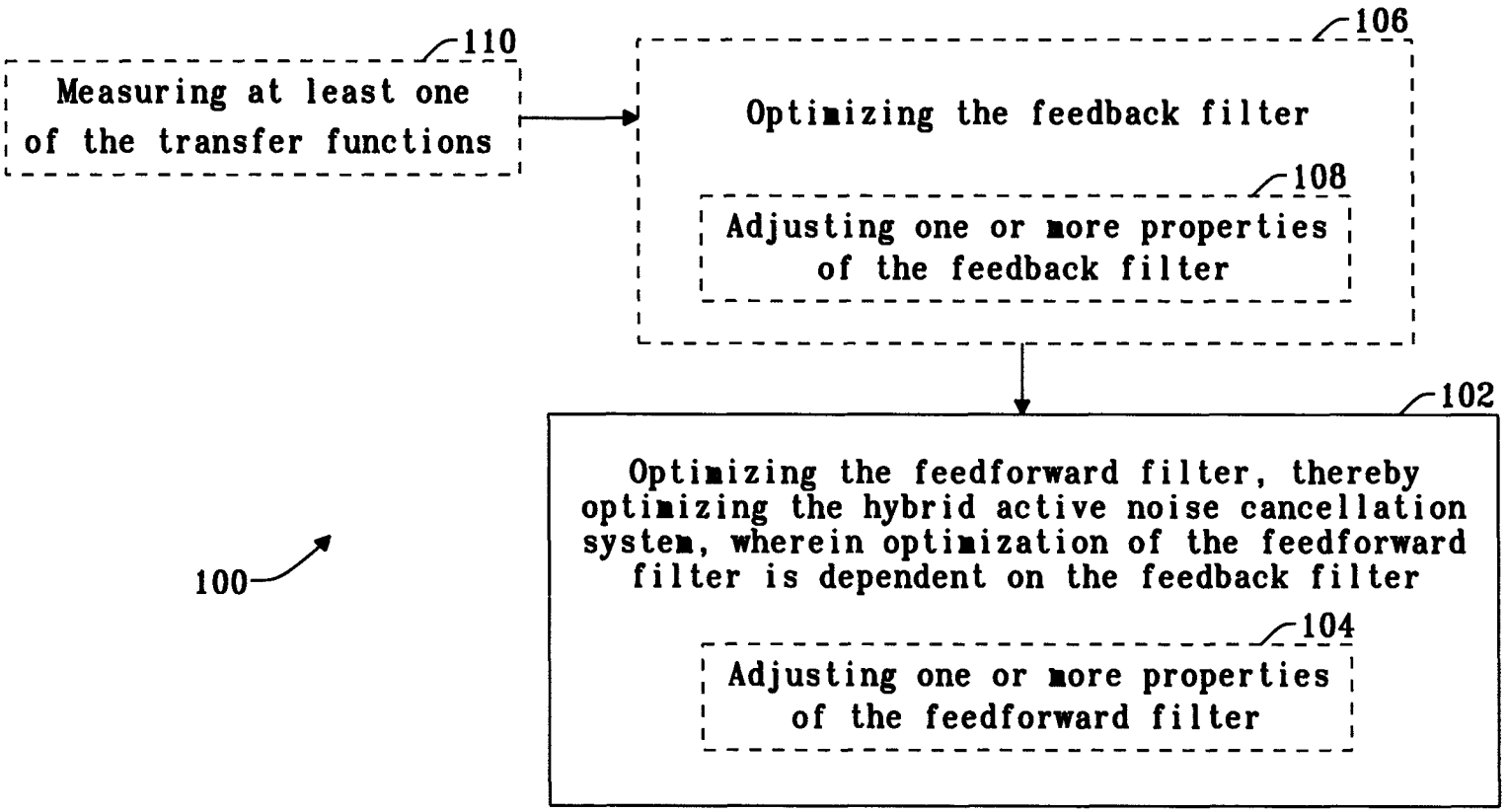
FIG. 1 is a flow chart of a method for automatically optimizing a hybrid active noise cancellation (ANC) system in accordance with a first embodiment of the present disclosure.
Figure 2:
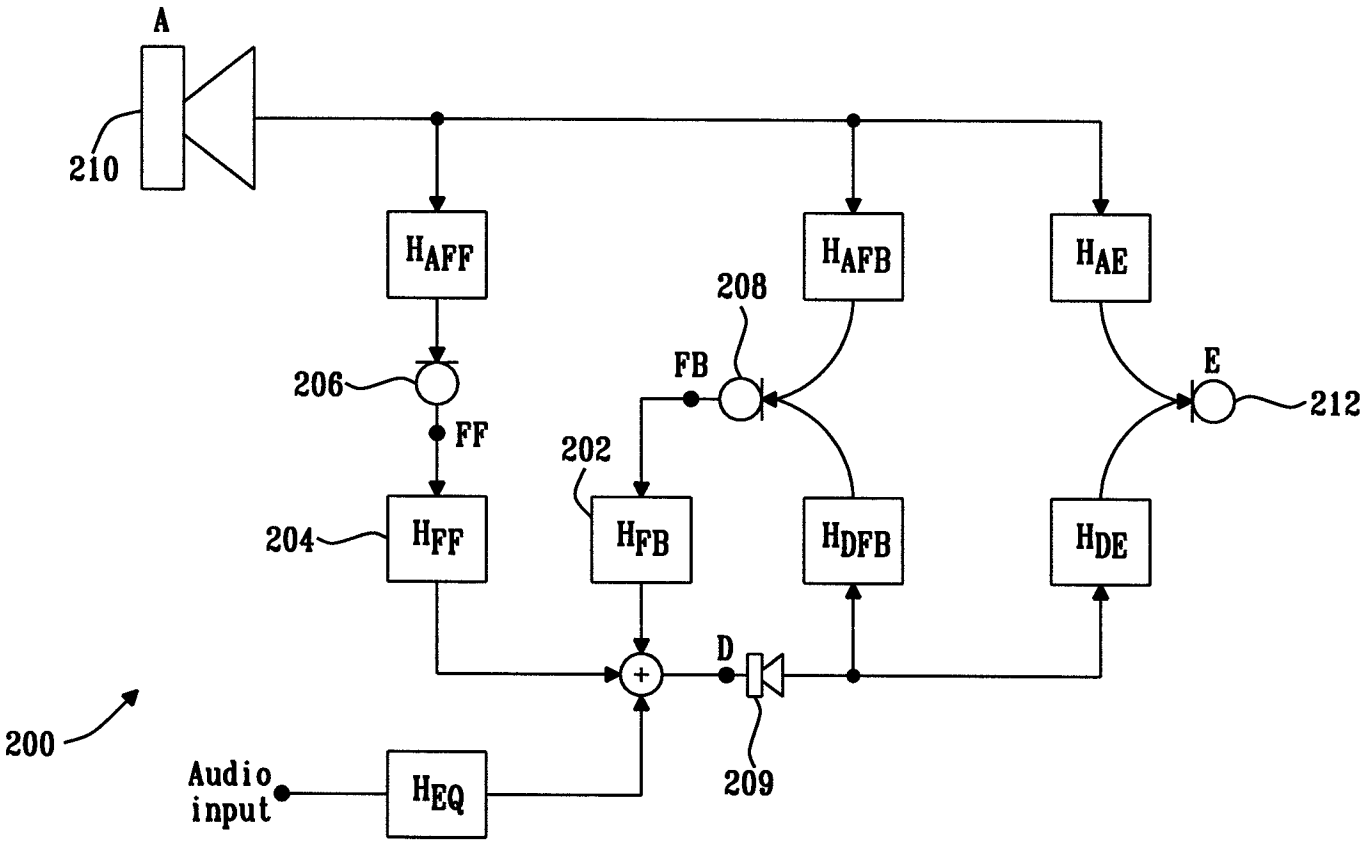
FIG. 2 is a schematic of the hybrid ANC system.

FIG. 1 is a flow chart of a method 100 for automatically optimizing a hybrid active noise cancellation (ANC) system 200 in accordance with a first embodiment of the present disclosure. FIG. 2 is a schematic of the hybrid ANC system 200, comprising a feedback filter 202 and a feedforward filter 204. The method 100 comprises optimizing the feedforward filter 204, thereby optimizing the hybrid ANC system 200, as a step 102. Optimization of the feedforward filter 204 is dependent on the feedback filter 202.

The hybrid ANC system 200 further comprises a feedforward microphone 206, a feedback microphone 208 and a speaker driver 209. Also shown is an ambient noise source 210 and a listener's ear 212. The hybrid ANC system 200 may, for example, be implemented within a headphone.

Optimizing the feedforward filter 204 may comprise adjusting one or more properties of the feedforward filter 204 such as a feedforward filter transfer function $H_{FF}$, at a step 104. The feedforward filter transfer function $H_{FF}$ may be a tunable digital transfer function. The feedforward filter transfer function $H_{FF}$ may be adjusted by setting one or more filter coefficients of the feedforward filter 204.

A property of the feedback filter 202 may comprise a feedback filter transfer function $H_{FB}$, and the adjustment to the feedforward filter transfer function $H_{FF}$ may be dependent on the feedback filter transfer function $H_{FB}$.

In a specific embodiment, the feedback filter 202 may be optimized prior to optimization of the feedforward filter 204, at a step 106. Optimizing the feedback filter 202 may comprise adjusting one or more properties of the feedback filter, for example, the feedback filter transfer function $H_{FB}$, at a step 108. The feedback filter transfer functions $H_{FB}$ may be a tunable digital transfer function. The feedback filter transfer functions $H_{FB}$ may be adjusted by setting one or more filter coefficients of the feedback filter 202.

With reference to FIG. 2 the hybrid ANC system 200 comprises a feedforward path comprising the feedforward filter 204 and the feedforward microphone 206. The hybrid ANC system 200 further comprises a feedback path comprising the feedback filter 202 and the feedback microphone 208. The speaker driver 209 is present in both the feedforward and feedback paths.

The feedforward path describes the signal path from the ambient noise source 210 to the user's ear 212 that implements feedforward filtering as provided by the inclusion of the feedforward filter 204 and the feedforward microphone 206. The different portions of the feedforward path may be described in terms of their transfer functions, thereby providing a model for the feedforward path that can be used to describe how a signal provided by the ambient noise source 210 is modified by the feedforward path as it passes to the user's ear 212.

The feedback path describes the signal path from the ambient noise source 210 to the user's ear 212 that implements feedback filtering as provided by the inclusion of the feedback filter 202 and the feedback microphone 208. The different portions of the feedback path may be described in terms of their transfer functions, thereby providing a model for the feedback path that can be used to describe how a signal provided by the ambient noise source 210 is modified by the feedback path as it passes to the user's ear 212.

The feedforward path comprises a transfer function $H_{AFF}$ between the ambient noise source 210 and the feedforward microphone 206. The feedforward path further comprises the feedforward filter transfer function $H_{FF}$ between the feedforward microphone 206 and the speaker driver 209. The feedforward path further comprises a transfer function $H_{DE}$ between the speaker driver 209 and the user's ear 212.

The feedback path comprises a transfer function $H_{AFB}$ between the ambient noise source 210 and the feedback microphone 208. The feedback path further comprises the feedback filter transfer function $H_{FB}$ between an output of feedback microphone 208 and an input of the speaker driver 209. The feedback path further comprises a transfer function $H_{DF}B$ between an input of the feedback microphone 208 and an output of the speaker driver 209

The hybrid ANC system further comprises a transfer function $H_{AE}$ between the ambient noise source 210 and the user's ear 212.

An audio input to the hybrid ANC system 200 is also shown in FIG. 2. Typically, the headphone speaker response of the speaker driver 209 is distorted by the closed loop operation. A configurable digital filter $H_{EQ}$ may be tuned to compensate the feedback influence.

As described with reference to FIG. 2, there are transfer functions that can describe the behavior of the hybrid ANC system 200. It is possible to measure the transfer functions $H_{AFF}$, $H_{AFB}$, $H_{AE}$, $H_{DFB}$, $H_{DE}$ from a physical implementation of the hybrid ANC system 200. Optimal determination of the transfer functions $H_{FF}$, $H_{FB}$ may be provided by one or more of the methods described herein.

Equation (1) defines the optimal tuning of the feedforward transfer function $H_{FF}$ as derived from FIG. 2, when a feedback filter path is not present:

$$H_{AFF} \cdot H_{FF} \cdot H_{DE} + H_{AE} \rightarrow 0 \tag{1}$$

If equation (1) is solved for $H_{FF}$, then the following relationship is derived:

$$H_{FF} \rightarrow -\frac{H_{AE}}{H_{AFF} \cdot H_{DE}} \tag{2}$$

As it is desirable that the transfer function $H_{FF}$ of the designed feedforward filter 204 for the feedforward microphone 206 approximates the right-hand part of equation (2), it can be considered as a target of the feedforward filter 204 design. It should be noted that equations (1) and (2) are correct only when the feedforward path is tuned independently of the feedback path.

In a specific embodiment, the adjustment to the feedforward filter transfer function $H_{FF}$ may be dependent on a frequency response $H'_{DE}$ at the user's ear 212, where the frequency response $H'_{DE}$ is a result of the speaker driver 209. The frequency response H'DE is dependent on the feedback filter transfer function $H_{FB}$.

The driver to ear frequency response $H'_{DE}$ under the influence of the feedback path, may be described as follows:

$$H'_{DE} = \frac{H_{DE}}{1 - H_{DFB} \cdot H_{FB}} \tag{3}$$

In a specific embodiment, optimizing the feedback filter 202 may comprise estimating a frequency response $H_{EFB}$ of the hybrid ANC system 200 at the user's ear 212 due to the feedback filter 202, and determining the adjustment to be applied to the feedback filter transfer function $H_{FB}$ based on the frequency response $H_{EFB}$.

For an already tuned and known feedback filter 202, the hybrid ANC system 200 operation frequency response $H_{EFB}$ at the listener's ear 212 can be described as follows:

$$H_{EFB} = H_{AE} + \frac{H_{AFB} \cdot H_{FB} \cdot H_{DE}}{1 - H_{DFB} \cdot H_{FB}} \tag{4}$$

Equation (4) can derive the frequency response $H_{EFB}$ at the ear 212 during feedback filter 202 operation prior to the feedforward filter 204 tuning.

In a specific embodiment, the optimum and most reliable feedforward filter 204 tuning with the presence of an already tuned feedback path may be provided by combining equations (1), (3), (4) as follows:

$$H_{AFF} \cdot H_{FF} \cdot H'_{DE} + H_{EFB} \rightarrow 0 \tag{5}$$

The optimization criterion is the minimization of the error in equation (5). By using equation (5), the optimum target for the feedforward filter frequency response $H_{FF}$ in hybrid operation can be determined as:

$$H_{FF} \rightarrow -\frac{H_{AE} \cdot (1 - H_{DFB} \cdot H_{FB}) + H_{AFB} \cdot H_{DE} \cdot H_{FB}}{H_{AFF} \cdot H_{DE}} \tag{6}$$

In a specific embodiment, determining the adjustment to be applied to the feedback filter transfer function $H_{FB}$ based on the frequency response $H_{EFB}$ may comprise determining the feedback filter transfer function $H_{FB}$ that reduces the frequency response $H_{EFB}$ to approximately zero:

$$H_{EFB} \rightarrow 0 \tag{7}$$

This may be achieved by reducing the feedback filter 202 tuning to a regression problem provided by equation (4) and requiring that the condition of equation (7) is met. Therefore, determining that the feedback filter transfer function $H_{FB}$ that reduces the second frequency response $H_{EFB}$ to approximately zero may comprise applying a regression method.

The regression method may be implemented as an automated algorithmic method that optimizes the feedback and feedforward filters 202, 204 for a defined target.

The regression method may, for example, be a least mean square method and/or a weighted regression algorithmic method. The weighted values of the weighted regression algorithmic method may be user controlled by allowing a user to assign weight values over frequency points. The weighted method can allow a user to influence the final result.

Equation (7) offers a novel means to estimate feedback filter 202 operation on the listener's ear 212 and hence, a reference for its tuning.

The method 100 may further comprise measuring at least one of the transfer functions $H_{AFF}$, $H_{DE}$, $H_{AFB}$, $H_{DFB}$, $H_{AE}$, at a step 110. 20. A specialized acoustic measurement setup may be used to measure the transfer functions $H_{AFF}$, $H_{DE}$, $H_{AFB}$, $H_{DFB}$, $H_{AE}$ of a physical implementation of the hybrid ANC system 200.

Determining the adjustment to be applied to the feedback filter transfer function $H_{FB}$ based on the frequency response $H_{EFB}$ may use one or more of the measured transfer functions $H_{DE}$, $H_{AFB}$, $H_{DFB}$, $H_{AE}$ for equation (4).

Once the feedback filter transfer function $H_{FB}$ has been estimated, it is possible to then determine the feedforward filter transfer function $H_{FF}$, where the feedforward filter transfer function $H_{FF}$ is dependent on the estimate of the feedback filter transfer function $H_{FB}$. The feedforward filter transfer function $H_{FF}$ may, for example, be determined using equation (6). The feedback filter transfer function $H_{FB}$ may be determined using the methods described herein, or any other suitable method in accordance with the understanding of the skilled person.

In summary, a specific embodiment of the method 100 may be described as follows:

1. Measure the transfer functions $H_{DE}$, $H_{AFB}$, $H_{DFB}$, $H_{AE}$ (provided by the step 110 of the method 100)
2. Estimate the frequency response $H_{EFB}$ of the feedback filter 202 operation at the listener's ear 212 (provided by equation (4) and part of the step 102 of the method 100)
3. Determine driver to ear frequency response $H'_{DE}$ under the influence of the feedback path (provided by equation (3) and part of the step 102 of the method 100)
4. Determine the influence of the feedback operation in the target response of the feedforward filter 204 design for tuning the hybrid ANC system 200 (provided by equation (6) and part of the step 102 of the method 100).

In an alternative embodiment it is possible to measure $H_{EFB}$ directly rather than by applying equation (4).

Figure 3:
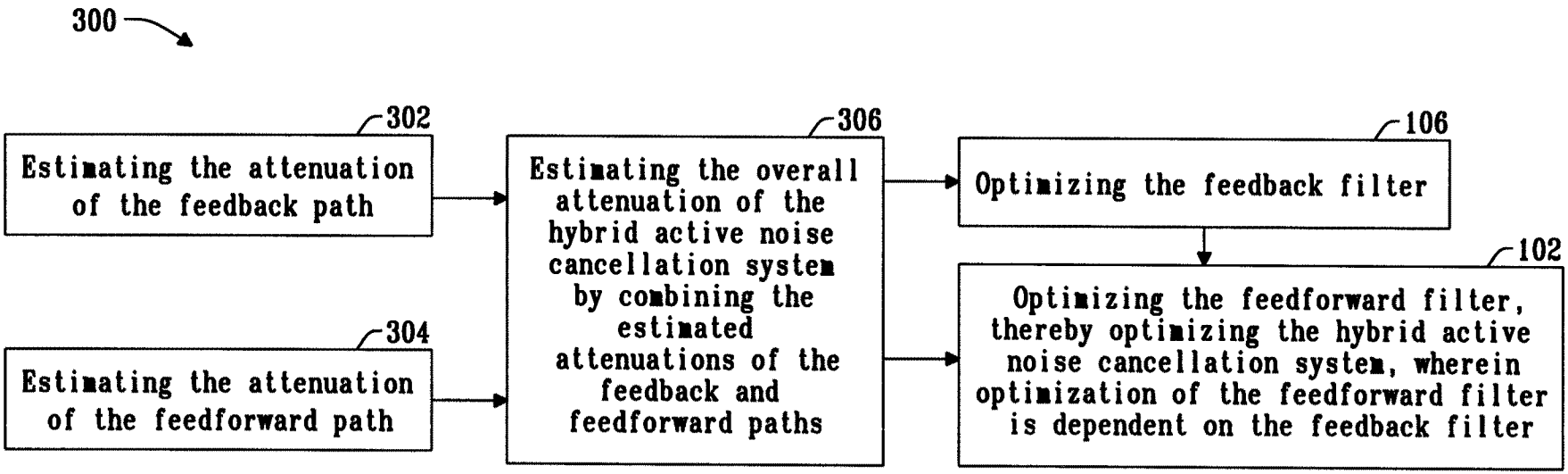
FIG. 3 is a flow chart of a method in accordance with a second embodiment of the present disclosure.

FIG. 3 is a flow chart of a method 300 in accordance with a second embodiment of the present disclosure. Common reference numerals and variables between Figures represent common features. It will be appreciated that the method 300 may further comprise other steps and features of other methods described herein, such as the method 100, in accordance with the understanding of the skilled person.

The method 300 comprises estimating the attenuation of the feedback path at a step 302 and estimating the attenuation of the feedforward path at a step 304. Optimizing the feedback filter 202 and the feedforward filter 204 uses the estimated attenuations of the feedback path and feedforward path.

An estimate of the attenuation of the feedback path may be provided by determining the relative feedback ANC attenuation at the listener's ear 212 is as follows:

$$H_{FBANC} = \frac{H_{EFB}}{H_{AE}} \tag{8}$$

Equation (8) describes the relative attenuation of the feedback filter 202.

An estimate of the attenuation of the feedforward path may be provided by determining the relative feedforward ANC performance as follows $$H_{FFANC} = \frac{H_{AFF} \cdot H_{FF} \cdot H'_{DE} + H_{EFB}}{H_{EFB}} \tag{9}$$

Equation (9) relates to the optimized feedforward filter 204 in hybrid operation is defined over the frequency response $H_{EFB}$ state at the listener's ear 212. Equation (9) describes the relative attenuation of the feedforward filter 204.

The method 300 may further comprise estimating the overall attenuation of the hybrid ANC system 200 by combining the estimated attenuations of the feedback and feedforward paths, at a step 306. Optimizing the feedback and feedforward filters 202, 204 may use the estimated overall attenuation of the hybrid ANC system.

The overall relative ANC attenuation of the ANC system 200 that was tuned with the equation (6), may be given by:

$$H_{ANC} = H_{FBANC} \cdot H_{FFANC} = \frac{H_{AFF} \cdot H_{FF} \cdot H'_{DE} + H_{EFB}}{H_{AE}} \tag{10}$$

Optimizing the feedback and feedforward filters 202, 204 using the estimated overall attenuation of the hybrid ANC system 200 may comprise adjusting one or more weightings used in the regression method based on the estimated overall attenuation.

The results of equations (8), (9) and (10) may be used for illustrating the final optimized filters' performance in a software embodiment of the method. In that way, a user can fine-tune via a weight vector influence of the regression method.

Moreover, the method described in relation to equations (8), (9), and (10) yields high accuracy between estimation and measurement. Hence, relying on the estimation provided by equations (8), (9) and (10) is a reliable way to design the filters even if there is no means to confirm with a measurement.

A specific embodiment of the method 300 may be summarized as follows:

1. Measure the transfer functions $H_{DE}$, $H_{AFB}$, $H_{DFB}$, $H_{AE}$ (provided by the step 110 of the method 100, and not shown in FIG. 3)
2. Estimate the frequency response $H_{EFB}$ of the feedback filter 202 operation at the listener's ear 212 (provided by equation (4) and part of the step 102 of the method 100)
3. Determine driver to ear frequency response $H'_{DE}$ under the influence of the feedback path (provided by equation (3) and part of the step 102 of the method 100)
4. Determine the influence of the feedback operation in the target response of the feedforward filter 204 design for tuning the hybrid ANC system 200 (provided by equation (6) and part of the step 102 of the method 100).

5. Compute the overall combined relative attenuation using equation (10).

The filters 202, 204 in the hybrid ANC system 200 may be adaptive such that the method 300 is implemented in an adaptive filter design algorithm. The adaptive filter design algorithm may be a real-time correction algorithm or a single operation that is triggered by an end user for fine-tuning the system to fit the hearing preferences of a user.

In a further embodiment, the hybrid ANC system 200 may combine both manual and automatic control, for example by enabling a user to override the automatic adjustment of the transfer functions or to apply weightings to one or more of the calculations.

Steps 2 to 5 may be repeated to achieve the required cancellation performance for the hybrid ANC system 200, for example by applying a regression technique.

Figure 4:
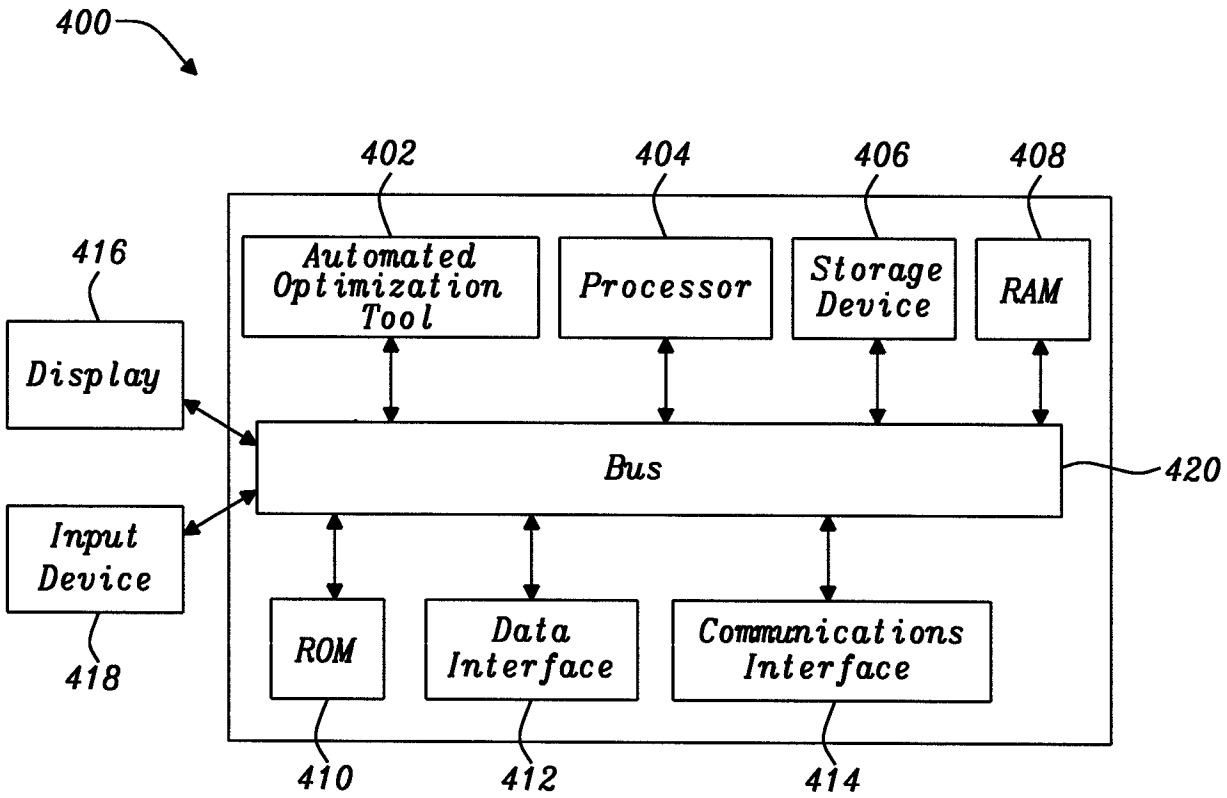
FIG. 4 is a schematic of a computer system in accordance with a third embodiment of the present disclosure.

FIG. 4 is a schematic of a computer system 400 comprising a module 402 configured as a hybrid active noise cancellation system automatic optimization tool for the optimization of the hybrid active noise cancellation system 200, in accordance with a third embodiment of the present disclosure. The hybrid active noise cancellation system automatic optimization tool may be configured to carry out the steps of the methods described herein, such as the methods 100, 300.

The computer system 400 may comprise a processor 404, a storage device 406, RAM 408, ROM 410, a data interface 412, a communications interface 414, a display 416, and an input device 418. The computer system 400 may comprise a bus 420 to enable communication between the different components.

The computer system 400 may be configured to load an application. The instructions provided by the application may be carried out by the processor 404. The application may be the hybrid active noise cancellation system automatic optimization tool.

Figure 5:
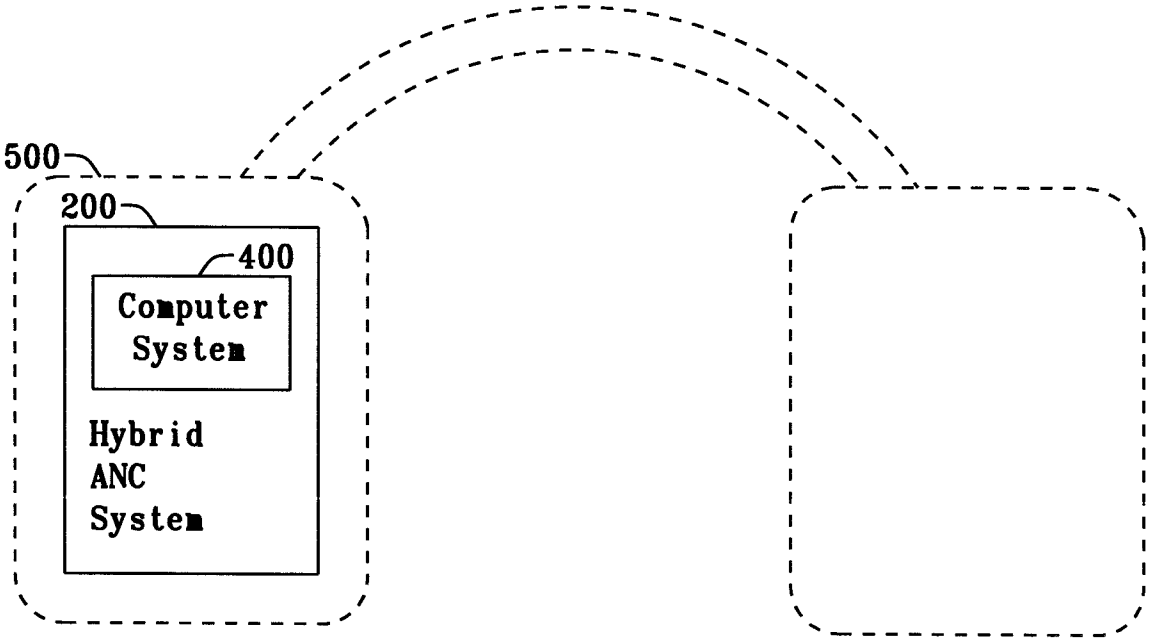
FIG. 5 is a schematic of the hybrid active noise cancellation system comprising the computer system of FIG. 4, in accordance with a fourth embodiment of the present disclosure.

FIG. 5 is a schematic of the hybrid active noise cancellation system 200 comprising the computer system 400, in accordance with a fourth embodiment of the present disclosure. The computer system 400 may, for example, be implemented on an integrated circuit within the hybrid ANC system 200. When implemented within the hybrid active noise cancellation system 200, the computer system 400 may function to automatically optimize the hybrid ANC system when in use, or prior to use, for example on the instruction of a user.

In a specific embodiment, the computer system 400 may comprise circuitry for measuring the overall attenuation, as previously discussed in relation to the method 300, where the circuitry functions to determine appropriate weightings to be applied in the regression method, and then performs automatic adjustments until optimization is attained.

In specific embodiments, the hybrid ANC system 200 may be implemented within a headphone or set of headphones 500. The headphone or set of headphones may be implemented within a headset that further comprises a microphone. The headphone may, for example, be in-ear, on-ear, over-ear or circum-aural.

A user may interact with the computer system 400 using a user interface, for example provided by the display 416 and the input device 418, to instruct the computer system 400 to implement the methods of the present disclosure in the optimization of a hybrid ANC system. In an alternative embodiment, the user interface may otherwise be provided, for example by a wireless or wired communication interface to permit the user to interact with the computer system 400 using an external device, such as a smart phone.

The user interface may enable the user to adjust one or more parameters of the hybrid active noise cancellation system automatic optimization tool relating to the optimization of the hybrid active noise cancellation system. For example, the interface may permit the user to adjust settings relating to the methods 100, 300 such as the weightings of a regression algorithm.

Data may be stored in a memory element, for example provided by the storage device 406 of the computer system 400. The data may include, for example, the transfer functions as measured, such as the transfer functions $H_{DE}$, $H_{AFB}$, $H_{DFB}$, $H_{AE}$, as may be implemented in the method 100.

The methods disclosed herein may be applied by a manufacturer of a hybrid ANC system, and/or may be applied for fine-tuning an end product to meet the requirements of the end-user, by the end-user.

Figure 6A:
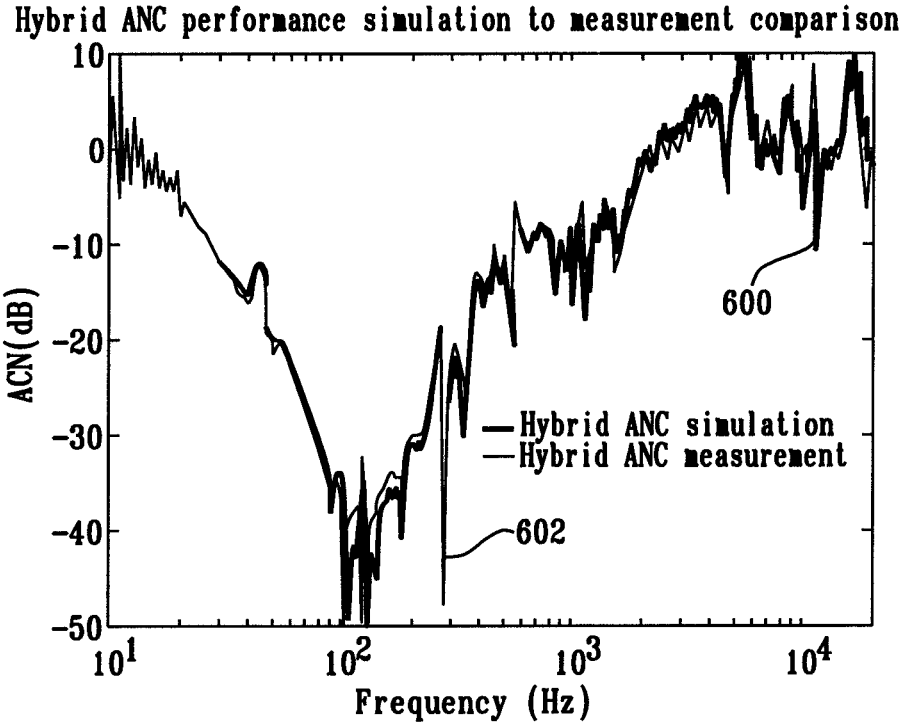
FIG. 6A is a graph showing simulation results of the ANC performance of the hybrid ANC system using the method of the present disclosure, compared with measurement results of a physical implementation of an in-ear headphone comprising the hybrid ANC system having been optimized using the method.

FIG. 6A is a graph showing simulation results (labelled by reference numeral 600) of the ANC performance of the hybrid ANC system 200 using the method 300, compared with measurement results (labelled by reference numeral 602) of a physical implementation of an in-ear headphone comprising the hybrid ANC system 200 having been optimized using the method 300.

Figure 6B:
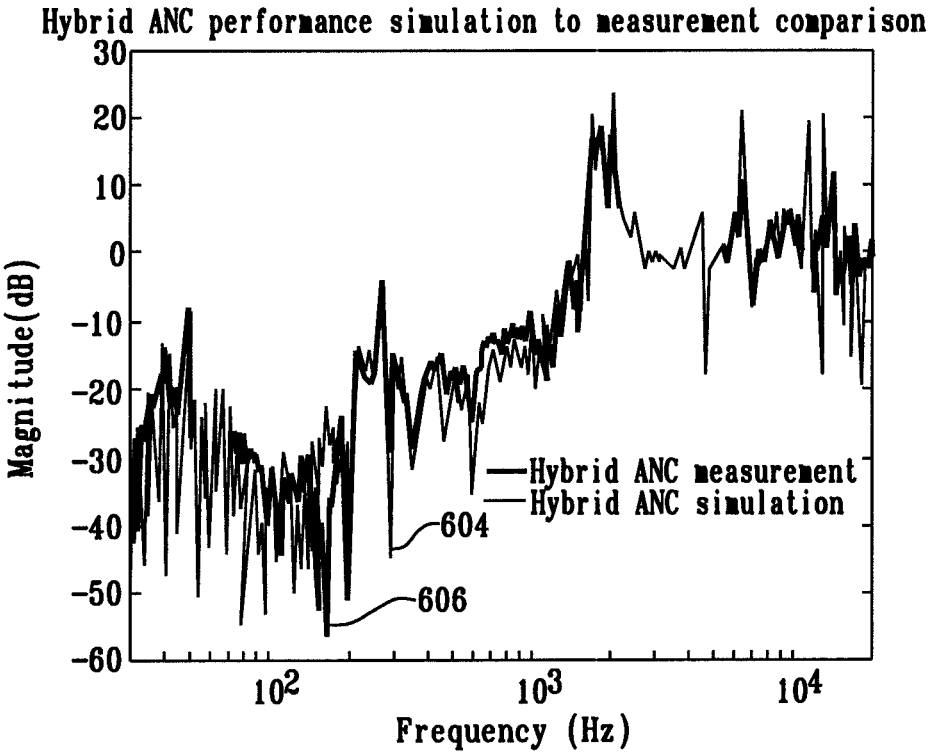
FIG. 6B is a graph showing simulation results of the ANC performance of the hybrid ANC system using the method of the present disclosure, compared with measurement results of a physical implementation of an circum-aural headphone comprising the hybrid ANC system having been optimized using the method.

FIG. 6B is a graph showing simulation results (labelled by reference numeral 604) of the ANC performance of the hybrid ANC system 200 using the method 300, compared with measurement results (labelled by reference numeral 606) of a physical implementation of an circum-aural headphone comprising the hybrid ANC system 200 having been optimized using the method 300.

As shown by FIGS. 6A and 6B there is good agreement between simulation and measurement thereby demonstrating that the methods disclosure herein provide an accurate and efficient tool for determining the attenuation capabilities of a headphone under tuning.

The present disclosure teaches methods to design the combination of the feedback and feedforward paths of a hybrid ANC system in order to achieve an optimal and reliable hybrid attenuation result. It provides a workflow and estimation procedure that overcomes or mitigates the disadvantages of known systems without the introduction of a complicated measurement procedure, as would be required to measure $H_{DE}$ under the influence of $H_{FB}$. More specifically, the target feedforward filter transfer function is accurately estimated by involving the influence from the already designed feedback filter.

The methods disclosed herein provide an effective approach to designing feedback and feedforward paths so that their combination yields an accurately estimated and controllable hybrid attenuation performance.

Various improvements and modifications may be made to the above without departing from the scope of the disclosure.

What is claimed is:

1. A computer-implemented method for automatically optimizing a hybrid active noise cancellation system, the hybrid active noise cancellation system comprising a feedback filter and a feedforward filter, the method comprising:

optimizing the feedback filter prior to optimizing the feedforward filter, wherein optimizing the feedback filter comprises:

i) estimating a second frequency response of an adaptive noise cancellation system at a user's ear, the second frequency response being due to the feedback filter;

ii) determining an adjustment to be applied to a feedback filter transfer function based on the second frequency response; and iii) adjusting the feedback filter transfer function; and optimizing the feedforward filter, thereby optimizing the hybrid active noise cancellation system, wherein optimization of the feedforward filter is dependent on the feedback filter.

2. The computer-implemented method of claim 1, wherein optimizing the feedforward filter comprises adjusting one or more properties of the feedforward filter.

3. The computer-implemented method of claim 2, wherein the one or more properties of the feedforward filter comprises a feedforward filter transfer function.

4. The computer-implemented method of claim 3, wherein the feedforward filter transfer function is adjusted by setting one or more filter coefficients of the feedforward filter.

5. The computer-implemented method of claim 3, wherein a property of the feedback filter comprises a feedback filter transfer function, and the adjustment to the feedforward filter transfer function is dependent on the feedback filter transfer function.

6. The computer-implemented method of claim of claim 5, wherein: the hybrid active noise cancellation system comprises a speaker driver; and the adjustment to the feedforward filter transfer function is dependent on a first frequency response at a user's ear, the first frequency response being due to the speaker driver and the first frequency response being dependent on the feedback filter transfer function.

7. The computer-implemented method of claim 5 wherein, the hybrid active noise cancellation system comprises:

a speaker driver;

a feedforward path comprising the feedforward filter and a feedforward microphone; and a feedback path comprising the feedback filter and a feedback microphone.

8. The computer-implemented method of claim 7, wherein:

a) the feedforward path comprises:

i) a first transfer function between an ambient noise source and the feedforward microphone;

ii) the feedforward filter transfer function between the feedforward microphone and the speaker driver; and iii) a second transfer function between the speaker driver and a user's ear; and b) the feedback path comprises:

i) a third transfer function between the ambient noise source and the feedback microphone;

ii) the feedback filter transfer function between an output of feedback microphone and an input of the speaker driver; and iii) a fourth transfer function between an input of the feedback microphone and an output of the speaker driver; and the hybrid active noise cancellation system further comprises a fifth transfer function between the ambient noise source and the user's ear.

9. The computer-implemented method of claim 8 comprising measuring at least one of the first, second, third, fourth or fifth transfer functions.

10. The computer-implemented method of claim 9, wherein determining the adjustment to be applied to the feedback filter transfer function based on the second frequency response comprising determining the feedback filter transfer function that reduces the second frequency response to approximately zero using one or more of the second, third, fourth and fifth transfer functions.

11. The computer-implemented method of claim 1, wherein the feedback filter transfer functions is adjusted by setting one or more filter coefficients of the feedback filter.

12. The computer-implemented method of claim 1, wherein determining the adjustment to be applied to the feedback filter transfer function based on the second frequency response comprising determining the feedback filter transfer function that reduces the second frequency response to approximately zero.

13. The computer-implemented method of claim 12, wherein determining the feedback filter transfer function that reduces the second frequency response to approximately zero comprises applying a regression method.

14. The computer-implemented method of claim 13 wherein, the hybrid active noise cancellation system comprises:

a speaker driver;

a feedforward path comprising the feedforward filter and a feedforward microphone; and a feedback path comprising the feedback filter and a feedback microphone.

15. The computer-implemented method of claim 14 comprising:

estimating the attenuation of the feedback path;

estimating the attenuation of the feedforward path;

estimating the overall attenuation of the hybrid active noise cancellation system by combining the estimated attenuations of the feedback and feedforward paths; wherein:

optimization of the feedback and feedforward filters uses the estimated overall attenuation of the hybrid active noise cancellation system by adjusting one or more weightings used in the regression method based on the estimated overall attenuation.

16. An apparatus comprising a computer system comprising a module configured as a hybrid active noise cancellation system automatic optimization tool for the optimization of a hybrid active noise cancellation system comprising a feedback filter and a feedforward filter, the hybrid active noise cancellation system automatic optimization tool being configured to:

optimize the feedback filter prior to optimizing the feedforward filter, by:

i) estimating a second frequency response of an adaptive noise cancellation system at a user's ear, the second frequency response being due to the feedback filter;

ii) determining an adjustment to be applied to a feedback filter transfer function based on the second frequency response; and iii) adjusting the feedback filter transfer function; and optimize the feedforward filter, thereby optimizing the hybrid active noise cancellation system, wherein optimization of the feedforward filter is dependent on the feedback filter.

17. The apparatus of claim 16 comprising the hybrid active noise cancellation system, the hybrid active noise cancellation system comprising the computer system.

* * * * *